US006571754B1

(12) United States Patent
Cortes

(10) Patent No.: US 6,571,754 B1
(45) Date of Patent: Jun. 3, 2003

(54) INTERNAL COMBUSTION ENGINE

(76) Inventor: Ajejandro Cortes, 550 SW. 62nd Ave., Miami, FL (US) 33144

( * ) Notice: Subject to any disclaimer, the term of this patent is extended or adjusted under 35 U.S.C. 154(b) by 0 days.

(21) Appl. No.: 09/965,720

(22) Filed: Sep. 27, 2001

(51) Int. Cl.[7] ..... F02B 75/22
(52) U.S. Cl. ..... 123/54.1
(58) Field of Search ..... 123/54.1, 54.3, 123/55.3, 53.3

(56) References Cited

U.S. PATENT DOCUMENTS 4,026,252 A * 5/1977 Wrin ..... 123/197.1
4,026,377 A * 5/1977 Jones ..... 123/184.21
4,038,949 A * 8/1977 Farris ..... 123/44 C

* cited by examiner

*Primary Examiner*—Henry C. Yuen
*Assistant Examiner*—Hyder Ali

(57) ABSTRACT

An internal combustion engine for propelling a vehicle. The internal combustion engine includes a block having a substantially X-shaped cross-section. Each of the legs constituting a bank of cylinders, with a manifold assembly coupled between adjacent banks for the purpose of introducing fuel and expelling exhaust as standard pistons cycle through the cylinders rotating about a crankshaft.

9 Claims, 4 Drawing Sheets

INTERNAL COMBUSTION ENGINE

BACKGROUND OF THE INVENTION

1. Field of the Invention

The present invention relates to internal combustion engines and more particularly pertains to a new internal combustion engine for propelling a vehicle.

2. Description of the Prior Art

The use of internal combustion engines is known in the prior art. More specifically, internal combustion engines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,271,011; U.S. Pat. No. 3,584,610; U.S. Pat. No. 5,782,213; U.S. Pat. No. 2,254,817; U.S. Pat. No. 5,606,938; and U.S. Pat. No. 2,264,648.

While these devices fulfill their respective, particular objectives and requirements, the aforementioned patents do not disclose a new internal combustion engine. The inventive device includes a block having a substantially X-shaped cross-section. Each of the legs constituting a bank of cylinders, with a manifold assembly coupled between adjacent banks for the purpose of introducing fuel and expelling exhaust as standard pistons cycle through the cylinders rotating about a crankshaft.

In these respects, the internal combustion engine according to the present invention substantially departs from the conventional concepts and designs of the prior art, and in so doing provides an apparatus primarily developed for the purpose of propelling a vehicle.

SUMMARY OF THE INVENTION

In view of the foregoing disadvantages inherent in the known types of internal combustion engines now present in the prior art, the present invention provides a new internal combustion engine construction wherein the same can be utilized for propelling a vehicle.

The general purpose of the present invention, which will be described subsequently in greater detail, is to provide a new internal combustion engine apparatus and method which has many of the advantages of the internal combustion engines mentioned heretofore and many novel features that result in a new internal combustion engine which is not anticipated, rendered obvious, suggested, or even implied by any of the prior art internal combustion engines, either alone or in any combination thereof.

To attain this, the present invention generally comprises a block having a substantially X-shaped cross-section. Each of the legs constituting a bank of cylinders, with a manifold assembly coupled between adjacent banks for the,purpose of introducing fuel and expelling exhaust as standard pistons cycle through the cylinders rotating about a crankshaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new internal combustion engine apparatus and method which has many of the advantages of the internal combustion engines mentioned heretofore and many novel features that result in a new internal combustion engine which is not anticipated, rendered obvious, suggested, or even implied by any of the prior art internal combustion engines, either alone or in any combination thereof.

It is another object of the present invention to provide a new internal combustion engine which may be easily and efficiently manufactured and marketed.

It is a further object of the present invention to provide a new internal combustion engine which is of a durable and reliable construction.

An even further object of the present invention is to provide a new internal combustion engine which is susceptible of a low cost of manufacture with regard to both materials and labor, and which accordingly is then susceptible of low prices of sale to the consuming public, thereby making such internal combustion engine economically available to the buying public.

Still yet another object of the present invention is to provide a new internal combustion engine which provides in the apparatuses and methods of the prior art some of the advantages thereof, while simultaneously overcoming some of the disadvantages normally associated therewith.

Still another object of the present invention is to provide a new internal combustion engine for propelling a vehicle.

Yet another object of the present invention is to provide a new internal combustion engine which includes a block having a substantially X-shaped cross-section. Each of the legs constituting a bank of cylinders, with a manifold assembly coupled between adjacent banks for the purpose of introducing fuel and expelling exhaust as standard pistons cycle through the cylinders rotating about a crankshaft.

Still yet another object of the present invention is to provide a new internal combustion engine that is more compact, taking up less lateral room with the engine compartment, freeing room for other components and allowing more style modifications made to the body.

Even still another object of the present invention is to provide a new internal combustion engine that incorporates opposing cylinder heads rather than the usual straight or V-shaped designs while delivering ample power with less vibration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
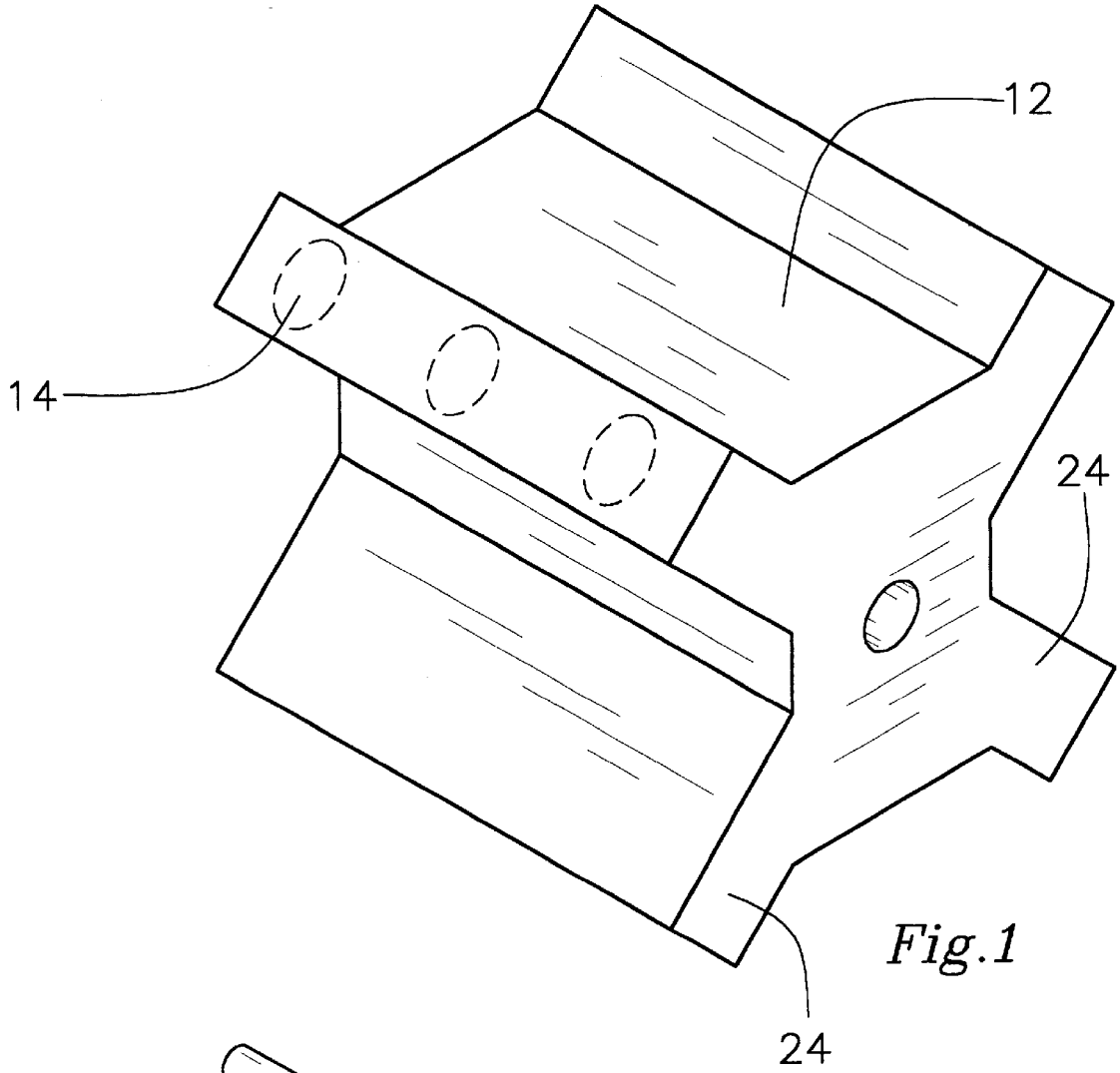
FIG. 1 is a perspective view of the block of a new internal combustion engine according to the present invention.
Figure 2:
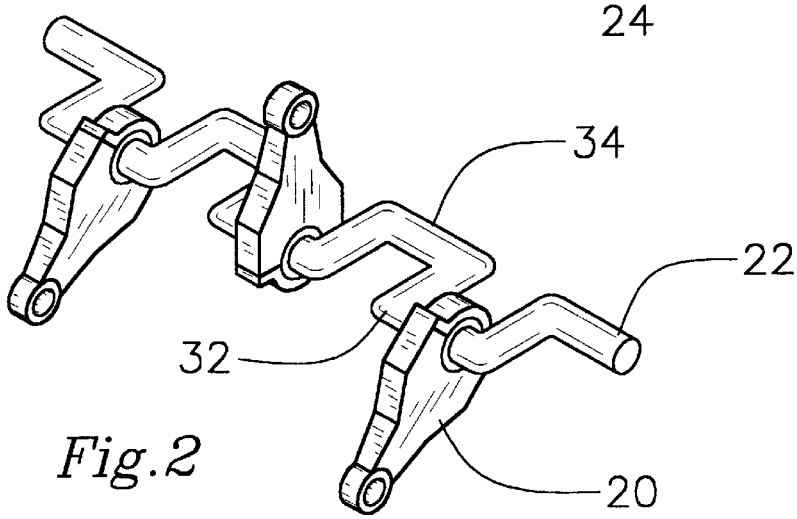
FIG. 2 is a perspective view of a portion of the crankshaft of the present invention.
Figure 3:
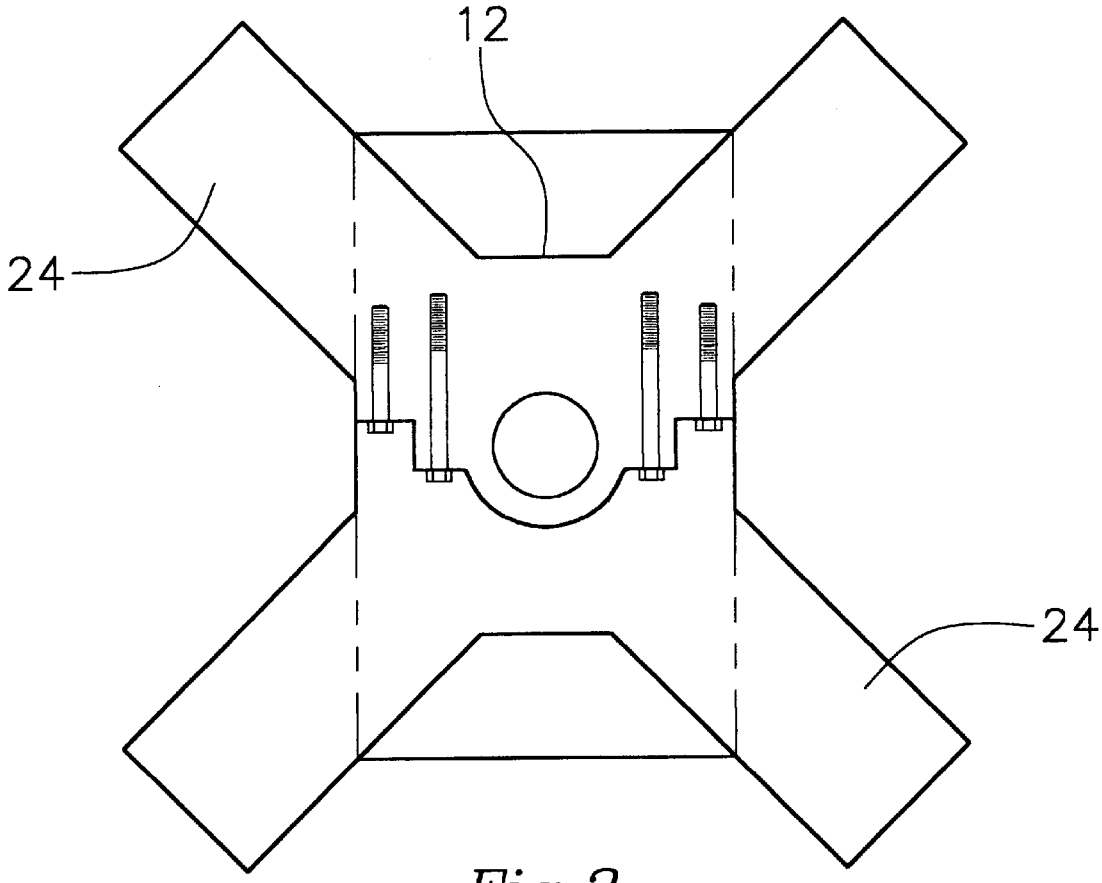
FIG. 3 is an end view of the block of the present invention.
Figure 4:
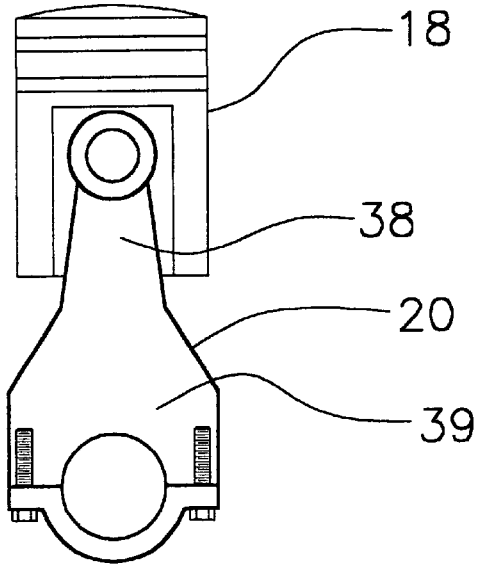
FIG. 4 is a side view of a rod and piston assembly of the present invention.
Figure 5:
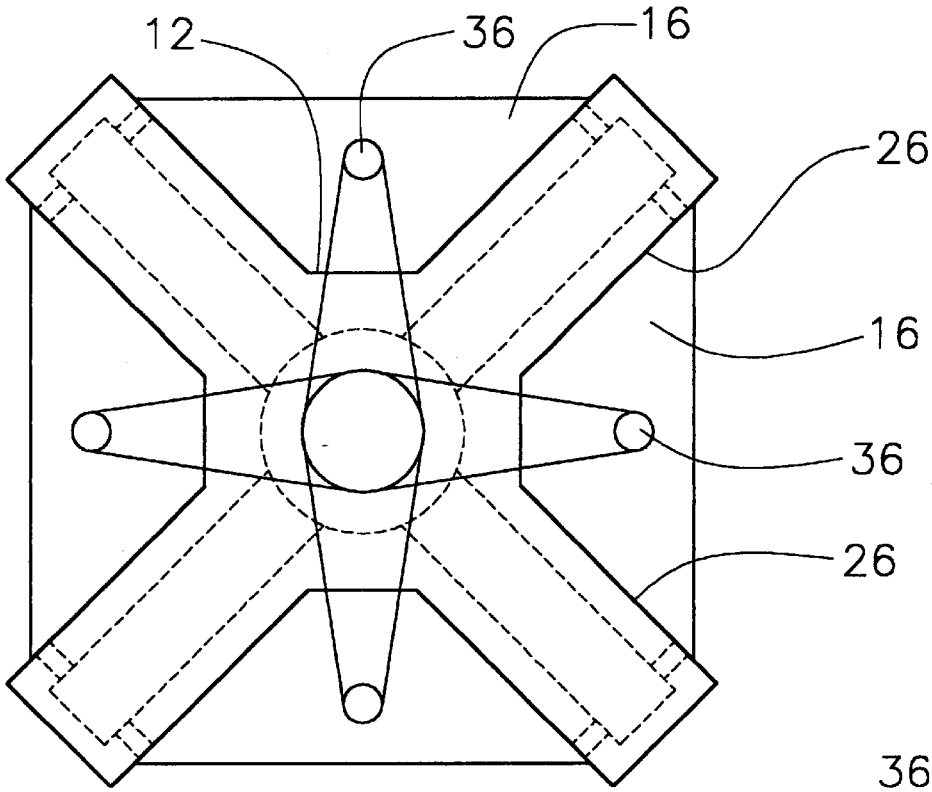
FIG. 5 is an end view showing the manifold assemblies of the present invention.

With reference now to the drawings, and in particular to FIGS. 1 through 7 thereof, a new internal combustion engine embodying the principles and concepts of the present invention and generally designated by the reference numeral 10 will be described.

As best illustrated in FIGS. 1 through 7, the internal combustion engine 10 generally comprises a block 12 that has a plurality of cylinders 14. Each of the cylinders 14 extends through the block 12. Each of the cylinders 14 is diametrically opposed from another of the cylinders 14.

A plurality of manifold assemblies 16 is coupled to the block 12. At least one of the manifold assemblies 16 is designed for controlling introduction of a fuel mixture into the cylinders 14 of the block 12. At least one of the manifold assemblies 16 is designed venting exhaust out of the cylinders 14 of the block 12.

A plurality of pistons 18 each is positioned in one of the cylinders 14 of the block 12. A plurality of rods 20 each is coupled to one of the pistons 18. Each of the rods 20 is coupled to a crankshaft 22. The crankshaft 22 is for controlling movement of each piston with an associated one of the cylinders 14. The crankshaft 22 is designed for coupling to a drive train of a vehicle such that the crankshaft 22 is designed for providing rotary motion when a user wishes to drive the vehicle.

Each of the pistons 18 is designed for compressing the fuel mixture when the pistons 18 are positioned proximate a top 23 of an associated one of the cylinders 14. Each of the pistons 18 is for sliding along a length of the associated one of the cylinders 14 when the compressed fuel mixture is ignited. Each of the pistons 18 is designed for exhausting the combusted fuel mixture when the pistons 18 return to the top 23 of the associated one of the cylinders 14.

The block 12 has a plurality of banks 24. The cylinders 14 are divided equally between the banks 24. Each of the banks 24 is diametrically opposed to another of the banks 24.

Each of the manifold assemblies 16 is positioned between a pair of adjacent banks 26. Each of the manifold assemblies 16 is in selective fluid communication with the cylinders 14 of an associated one of the banks 24. Each of the manifold assemblies 16 is for controlling introduction of the fuel mixture into the cylinders 14 and expulsion of the exhaust from the cylinders 14.

Each of the banks 24 has a plurality of inlet ports 28 and a plurality of outlet ports 30. The inlet ports 28 are in fluid communication with an associated one of the manifold assemblies 16 such that the inlet ports 28 are designed for permitting introduction of the fuel mixture from the associated one of the manifold assemblies 16. The outlet ports 30 are in fluid communication with an associated one of the manifold assemblies 16 such that the outlet ports 30 are designed for permitting expulsion of the exhaust from the cylinders 14.

The inlet ports 28 and the outlet ports 30 extend through sides 31 of each of the banks 24. The outlet ports 30 are positioned opposite the inlet ports 28. The outlet ports 30 are designed for permitting exhaust to be expelled into one of the manifold assemblies 16 such that the inlet ports 28 are designed for permitting introduction of the fuel mixture from another of the manifold assemblies 16.

The crankshaft 22 has a plurality of connection portions 32. Each of the connection portions 32 are coupled to an end of a spacer portion 34 such that each of the connection portions 32 is positioned opposite and adjacent one of the connection portions 32. Each of the rods 20 is coupled to one of the connection portions 32. Each of the connection portions 32 is offset from a longitudinal axis of the crankshaft 22 such that the crankshaft 22 is for cycling each of the pistons 18 through an associated one of the cylinders 14.

Each of the manifold assemblies 16 has a cam 36. The cam 36 of each of the manifold assemblies 16 is operationally coupled to the crankshaft 22. The cam 36 is designed for controlling introduction of the fuel mixture to the cylinders 14 when the crankshaft 22 is rotated. The cam 36 is designed for controlling expulsion of exhaust from the cylinders 14 when the fuel mixture is combusted when the crankshaft 22 is rotated.

Each of the rods 20 has a neck portion 38 and a base portion 39. The neck portion 38 of each of the rods 20 is coupled to an associated one of the pistons 18. The base portion 39 of each of the rods 20 is coupled to the crankshaft 22. Each of the rods 20 is for translating rotation of the crankshaft 22 to linear movement of the associated one of the pistons 18.

Figure 6:
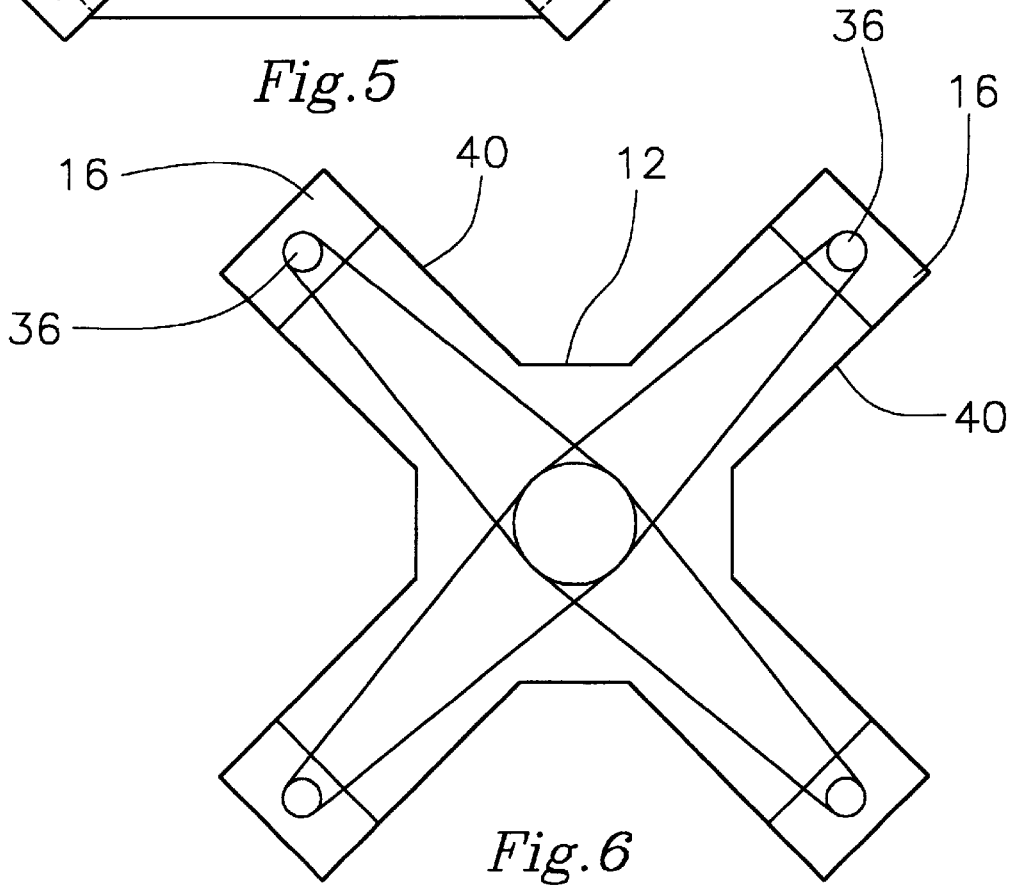
FIG. 6 is an end view of an alternate embodiment of the present invention.
Figure 7:
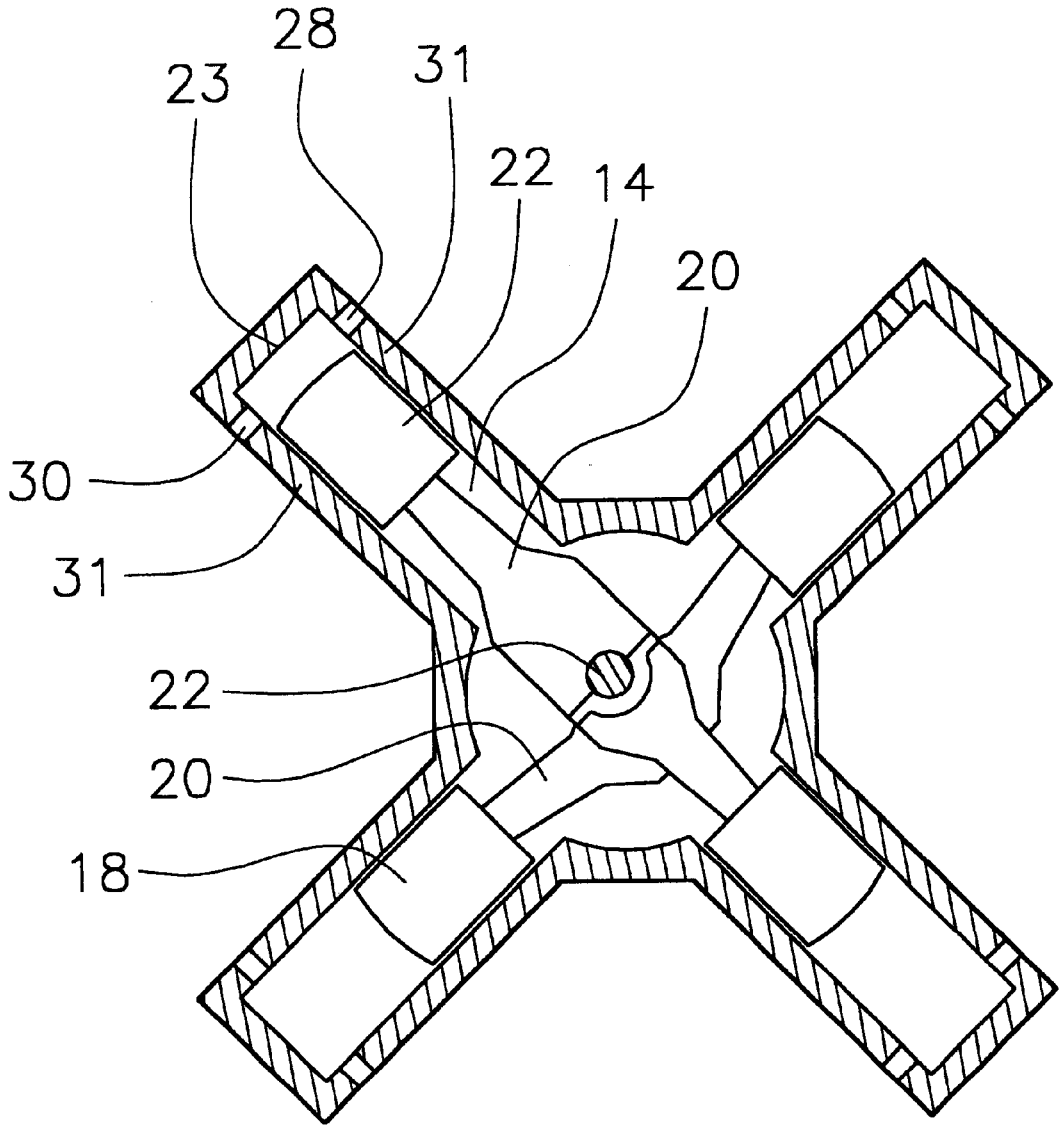
FIG. 7 is a cross-sectional view of the invention.

As an alternate embodiment as shown in FIG. 6, each of the manifold assemblies 16 is coupled to an upper end 40 of the banks 24. Each of the manifold assemblies 16 introduces the fuel mixture to the cylinders 14 of an associated one of the banks 24. Each of the manifold assemblies 16 permits expulsion of exhaust from the cylinders 14 of the associated one of the banks 24 when the fuel mixture has been combusted.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An internal combustion engine comprising:

a block having a plurality of cylinders, each of said cylinders extending through said block, each of said cylinders being diametrically opposed from another of said cylinders;

a plurality of manifold assemblies being coupled to said block, at least one of said manifold assemblies being adapted for controlling introduction of a fuel mixture into said cylinders of said block, at least one of said manifold assemblies being adapted venting exhaust away out of said cylinders of said block;

a plurality of pistons each being positioned in one of said cylinders of said block, a plurality of rods each being coupled to one of said pistons, each of said rods being coupled to a crankshaft, said crankshaft being for controlling movement of each said pistons with an associated one of said cylinders, said crankshaft being adapted for coupling to a drive train of the vehicle such that said crankshaft is adapted for providing rotary motion when the user wishes to drive the vehicle;

each of said pistons being adapted for compressing the fuel mixture when said pistons are positioned proximate a top of an associated one of said cylinders, each of said pistons being for sliding along a length of the associated one of said cylinders when the compressed fuel mixture is ignited, each of said pistons being adapted for exhausting the combusted fuel mixture when said pistons return to proximate said top of the associated one of said cylinders; and said crank shaft having a plurality of connection portions, each of said connection portions being coupled to an end of a spacer portion such that each of said connection portions is positioned opposite and adjacent one of said connection portions, each of said rods being coupled to one of said connection portions such that only one of said rods and the associated one of said pistons is coupled to each of said connection portions, each of said connection portions being offset from a longitudinal axis of said crank shaft such that said crank shaft is for cycling each of said pistons through an associated one of said cylinders.

2. The internal combustion engine as set forth in claim 1, further comprising:

said block having a plurality of banks, said cylinders being divided equally between said banks, each of said bank diametrically opposed to another of said banks.

3. The internal combustion engine as set forth in claim 2, further comprising:

each of said manifold assemblies being positioned between a pair of adjacent banks, each of said manifold assemblies being in selective fluid communication said cylinders of an associated one of said banks, each of said manifold assemblies being for controlling introduction of the fuel mixture into said cylinders and expulsion of the exhaust from said cylinders.

4. The internal combustion engine as set forth in claim 3, further comprising:

each of said banks having a plurality of inlet ports and a plurality of outlet ports, said inlet ports being in fluid communication with an associated one of said manifold assemblies such that said inlet ports are adapted for permitting introduction of the fuel mixture from the associated one of said manifold assemblies, said outlet ports being in fluid communication with an associated one of said manifold assemblies such that said outlet ports are adapted for permitting expulsion of the exhaust from said cylinders.

5. The internal combustion engine as set forth in claim 4, further comprising:

said inlet ports and said outlet ports extending through sides of each of said banks, said outlet ports being positioned opposite said inlet ports, said outlet ports being adapted for permitting exhaust to be expelled into one of said manifold assemblies such that said inlet ports are adapted for permitting introduction of the fuel mixture from another of said manifold assemblies.

6. The internal combustion engine as set forth in claim 2, further comprising:

each of said manifold assemblies being coupled to an upper end of said banks, each of said manifold assemblies introducing the fuel mixture to said cylinders of an associated one of said banks, each of said manifold assemblies permitting expulsion of exhaust from said cylinders of the associated one of said banks when said fuel mixture has been combusted.

7. The internal combustion engine as set forth in claim 1, further comprising:

each of said manifold assemblies having a cam, said cam of each of said manifold assemblies being operationally coupled to said crankshaft, said cam being adapted for controlling introduction of the fuel mixture to said cylinders when said crankshaft is rotated, said cam being adapted for controlling expulsion of exhaust from said cylinders when the fuel mixture is combusted when said crankshaft is rotated.

8. The internal combustion engine as set forth in claim 1, further comprising:

each of said rods having a neck portion and a base portion, said neck portion of said of each of said rods being coupled to an associated one of said pistons, said base portion of each of said rods being coupled to said crankshaft, each of said rods being for translating rotation of said crankshaft to linear movement of the associated one of said pistons.

9. An internal combustion engine comprising:

a block having a plurality of cylinders each of said cylinders extending through said block, each of said cylinders being diametrically opposed from another of said cylinders;

a plurality of manifold assemblies being coupled to said block, at least one of said manifold assemblies being adapted for controlling introduction of a fuel mixture into said cylinders of said block, at least one of said manifold assemblies being adapted venting exhaust away out of said cylinders of said block;

a plurality of pistons each being positioned in one of said cylinders of said block, a plurality of rods each being coupled to one of said pistons, each of said rods being coupled to a crankshaft, said crankshaft being for controlling movement of each said pistons with an associated one of said cylinders, said crankshaft being adapted for coupling to a drive train of the vehicle such that said crankshaft is adapted for providing rotary motion when the user wishes to drive the vehicle;

each of said pistons being adapted for compressing the fuel mixture when said pistons are positioned proximate a top of an associated one of said cylinders, each of said pistons being for sliding along a length of the associated one of said cylinders when the compressed fuel mixture is ignited, each of said pistons being adapted for exhausting the combusted fuel mixture when said pistons return to proximate said top of the associated one of said cylinders;

said block having a plurality of banks, said cylinders being divided equally between said banks, each of said bank diametrically opposed to another of said banks;

each of said manifold assemblies being positioned between a pair of adjacent banks, each of said manifold assemblies being in selective fluid communication said cylinders of an associated one of said banks, each of said manifold assemblies being for controlling introduction of the fuel mixture into said cylinders and expulsion of the exhaust from said cylinders;

each of said banks having a plurality of inlet ports and a plurality of outlet ports, said inlet ports being in fluid communication with an associated one of said manifold assemblies such that said inlet ports are adapted for permitting introduction of the fuel mixture from the associated one of said manifold assemblies said outlet ports being in fluid communication with an associated one of said manifold assemblies such that said outlet ports are adapted for permitting expulsion of the exhaust from said cylinders;

said inlet ports and said outlet ports extending through sides of each of said banks said outlet ports being positioned opposite said inlet ports, said outlet ports being adapted for permitting exhaust to be expelled into one of said manifold assemblies such that said inlet ports are adapted for permitting introduction of the fuel mixture from another of said manifold assemblies;

said crank shaft having a plurality of connection portions, each of said connection portions being coupled to an end of a spacer portion such that each of said connection portions is positioned opposite and adjacent one of said connection portions, each of said rods being coupled to one of said connection portions such that only one of said rods and the associated one of said pistons is coupled to each of said connection portions, each of said connection portions being offset from a longitudinal axis of said crank shaft such that said crank shaft is for cycling each of said pistons through an associated one of said cylinders;

each of said manifold assemblies having a cam, said can of each of said manifold assemblies being operationally coupled to said crankshaft, said cam being adapted for controlling introduction of the fuel mixture to said cylinders when said crankshaft is rotated, said cam being adapted for controlling expulsion of exhaust from said cylinders when the fuel mixture is combusted when said crankshaft is rotated;

each of said rods having a neck portion and a base portion, said neck portion of said of each of said rods being coupled to an associated one of said pistons, said base portion of each of said rods being coupled to said crankshaft, each of said rods being for translating rotation of said crankshaft to linear movement of the associated one of said pistons.

* * * * *